US011597110B2

(12) United States Patent
Kopelas et al.

(10) Patent No.: US 11,597,110 B2
(45) Date of Patent: Mar. 7, 2023

(54) HANDLE FOR A SHAVER ENABLING ROTATIONAL MOVEMENT OF A CARTRIDGE

(71) Applicant: BIC-VIOLEX SA, Attiki (GR)

(72) Inventors: Panagiotis Kopelas, Dafni-Athens (GR); Dimitrios Efthimiadis, Nea Kypseli (GR)

(73) Assignee: BIC-VIOLEX SA, Attiki (GR)

( * ) Notice: Subject to any disclaimer, the term of this patent is extended or adjusted under 35 U.S.C. 154(b) by 0 days.

(21) Appl. No.: 16/478,527

(22) PCT Filed: Jan. 10, 2018

(86) PCT No.: PCT/EP2018/050595
§ 371 (c)(1),
(2) Date: Jul. 17, 2019

(87) PCT Pub. No.: WO2018/134104
PCT Pub. Date: Jul. 26, 2018

(65) Prior Publication Data

US 2020/0039098 A1 Feb. 6, 2020

(30) Foreign Application Priority Data

Jan. 17, 2017 (EP) ..... 17151799

(51) Int. Cl.
*B26B 21/52* (2006.01)
*B26B 21/22* (2006.01)

(52) U.S. Cl.
CPC ..... *B26B 21/521* (2013.01); *B26B 21/225* (2013.01)

(58) Field of Classification Search
CPC ..... B26B 21/225; B26B 21/4068; B26B 21/4075; B26B 21/52; B26B 21/521;
(Continued)

(56) References Cited

U.S. PATENT DOCUMENTS 2,119,792 A * 6/1938 Parkin ..... B26B 21/52 30/531
3,935,639 A 2/1976 Terry et al.
(Continued)

FOREIGN PATENT DOCUMENTS

DE 102013213881 1/2015
EP 1245351 10/2002
(Continued)

OTHER PUBLICATIONS

International Search Report dated Apr. 12, 2018 in related PCT International Patent Application No. PCT/EP2018/050596, 2 pages.
(Continued)

*Primary Examiner* — Jason Daniel Prone
(74) *Attorney, Agent, or Firm* — Ruggiero, McAllister & McMahon LLC

(57) ABSTRACT

A handle for a shaver includes a handle body extending along a longitudinal axis of the handle; a connector for attaching a cartridge to the handle rotatable with respect to the handle body around a rotational axis perpendicular to the longitudinal axis; and an elastic tongue extending parallel with the longitudinal axis of the handle, when in a neutral position. The connector includes a cartridge end and a tongue end opposite to the cartridge end, the cartridge end of the connector being adapted to engage with the cartridge. The elastic tongue includes a first end and a second end. The first end of the elastic tongue is fixedly attached to or integral with the handle body. As the connector rotates the second end flexes towards a first extreme flexed position or a second extreme flexed position, the flexed elastic tongue biases the connector towards the rest position.

14 Claims, 8 Drawing Sheets

(58) Field of Classification Search
CPC ..... B26B 21/00; B26B 21/14; B26B 21/16; B26B 21/22; B26B 21/40; B26B 21/4012
USPC ..... 30/47–51, 526, 527
See application file for complete search history.

(56) References Cited

U.S. PATENT DOCUMENTS

| | | | | |
|---|---|---|---|---|
| 3,950,848 | A | 4/1976 | Goldstein | |
| 3,950,849 | A | 4/1976 | Perry | |
| 3,964,160 | A | 6/1976 | Gordon | |
| 4,152,828 | A | 5/1979 | Lund | |
| 4,403,414 | A | 9/1983 | Kiraly et al. | |
| 4,475,286 | A | 10/1984 | Saito | |
| 4,879,811 | A | 11/1989 | Cooney | |
| 5,029,391 | A | 7/1991 | Althaus et al. | |
| 5,038,472 | A | 8/1991 | Iderosa | |
| 5,050,301 | A | 9/1991 | Apprille, Jr. | |
| 5,953,824 | A | 9/1999 | Ferraro et al. | |
| 6,115,924 | A | 9/2000 | Oldroyd | |
| 6,381,857 | B1 | 5/2002 | Oldroyd | |
| 6,615,498 | B1 | 9/2003 | King et al. | |
| 7,137,205 | B2 | 11/2006 | Royle | |
| 7,461,456 | B2 | 12/2008 | Tsushio et al. | |
| 7,461,458 | B2 | 12/2008 | Peyser et al. | |
| 7,526,869 | B2 | 5/2009 | Blatter et al. | |
| 8,151,472 | B2 | 4/2012 | Dimitris et al. | |
| 8,732,965 | B2 | 5/2014 | Efthimiadis et al. | |
| 8,745,882 | B2 | 6/2014 | Murgida et al. | |
| 8,745,883 | B2 | 6/2014 | Murgida et al. | |
| 8,898,909 | B2 | 12/2014 | Schmitt | |
| 8,978,258 | B2 * | 3/2015 | Patel et al. | B26B 21/4093 30/527 |
| 9,469,038 | B2 | 10/2016 | Iaccarino et al. | |
| 9,522,472 | B2 | 12/2016 | Leicht et al. | |
| 9,707,688 | B2 | 7/2017 | Giannopoulos et al. | |
| 9,849,599 | B2 | 12/2017 | Gers-Barlag et al. | |
| 10,538,007 | B2 | 1/2020 | Zucker | |
| 10,836,059 | B2 | 11/2020 | Efthimiadis et al. | |
| 10,843,357 | B2 | 11/2020 | Jang | |
| 10,960,561 | B2 | 3/2021 | Kim | |
| 10,974,403 | B2 | 4/2021 | Chang | |
| 11,148,310 | B2 | 10/2021 | Maimone et al. | |
| 11,161,263 | B2 | 11/2021 | Parmele et al. | |
| 11,298,843 | B2 * | 4/2022 | Kopelas | B26B 21/521 |
| 2011/0247217 | A1 | 10/2011 | Johnson et al. | |
| 2012/0073149 | A1 * | 3/2012 | Murgida et al. | B26B 21/521 30/526 |
| 2012/0073150 | A1 * | 3/2012 | Murgida et al. | B26B 21/521 30/532 |
| 2012/0255185 | A1 * | 10/2012 | Patel et al. | B26B 21/4093 30/527 |
| 2013/0081290 | A1 * | 4/2013 | Murgida et al. | B26B 21/522 30/527 |
| 2015/0217466 | A1 | 8/2015 | Leicht et al. | |
| 2018/0021967 | A1 | 1/2018 | Murgida et al. | |
| 2019/0337174 | A1 | 11/2019 | Kopelas et al. | |
| 2019/0366570 | A1 | 12/2019 | Kopelas et al. | |
| 2020/0039098 | A1 | 2/2020 | Kopelas et al. | |
| 2021/0354322 | A1 | 11/2021 | Kopelas | |

FOREIGN PATENT DOCUMENTS

| | | |
|---|---|---|
| EP | 2508309 | 10/2012 |
| EP | 2902156 | 8/2015 |
| GB | 2096519 | 10/1982 |
| GB | 2116470 | 9/1983 |
| GB | 2463035 | 3/2010 |
| JP | 4-22388 | 1/1992 |
| WO | 93/20983 | 10/1993 |

OTHER PUBLICATIONS

Written Opinion dated Apr. 12, 2018 in related PCT International Patent Application No. PCT/EP2018/050596,4 pages.

International Search Report dated Apr. 20, 2018 in related PCT International Patent Application No. PCT/EP2018/050594, 2 pages.

Written Opinion dated Apr. 20, 2018 in related PCT International Patent Application No. PCT/EP2018/050594, 5pages.

International Search Report dated Apr. 12, 2018 in corresponding PCT International Patent Application No. PCT/EP2018/050595, 3 pages.

Written Opinion dated Apr. 12, 2018 in corresponding PCT International Patent Application No. PCT/EP2018/050595, 5pages.

U.S. Non-Final Office Action dated Jul. 31, 2020 in related U.S. Appl. No. 16/478,353, 14 pages.

* cited by examiner

HANDLE FOR A SHAVER ENABLING ROTATIONAL MOVEMENT OF A CARTRIDGE

CROSS REFERENCE TO RELATED APPLICATION

This application is the US National Stage Entry Application of International Application PCT/EP2018/050595, filed Jan. 10, 2018, now published as WO/2018/134104 which claims priority to European Application EP17151799.8 filed Jan. 17, 2017, the entire contents of which are incorporated herein by reference.

FIELD

The presented disclosure relates to wet shavers comprising a cartridge pivotable about two pivot axes, and especially to shavers including a shaving handle system comprising connectors adapted to enable pivoting of the cartridge around the two axes.

BACKGROUND

Razors are known that include a cartridge and a handle where the cartridge is configured to rotate about a first axis parallel to the blades and the handle includes a rotatable portion that rotates about a second axis perpendicular to the edge of the blade axis.

The rotatable portion will generally include a base and a retention system. Part of the retention system will include a cantilever tail having an elongate stem and a perpendicular bar. The perpendicular bar is loosely retained by a pair of offset walls which interfere with and twist the perpendicular bar such that the elongate stem flexes.

The present disclosure develops the idea of using a flexible tail in a configuration where the shortest distance between the first pivot axis and the second pivot axis is kept as low as possible, and where the first pivot axis and the second pivot axis intersect each other.

It has been studied and observed that such a system, in which two pivot axes are positioned close to or even intersect each other, require different approach and different arrangement of individual components, in order to ensure comfortable shaving and smooth operation of the whole system.

Moreover, further embodiments have been studied and developed, which increase even more the effectivity of shaving with such systems.

SUMMARY

The present disclosure involves a system for shavers, which enable pivotal movement about two pivot axes, where the axes are located close to each other, and may intersect each other. The following embodiments can be used, to achieve smooth and reliable operation of the shaver system. More particularly, one embodiment defines a handle for a shaver comprising a handle body including a hand gripping portion and extending along a longitudinal axis of the handle; a connector for attaching a cartridge to the handle, where the connector is rotatable with respect to the handle body around a rotational axis perpendicular to the longitudinal axis of the handle from a rest position and between a first extreme rotated position and a second extreme rotated position; and an elastic tongue which extends parallel with the longitudinal axis of the handle, when in a neutral position. The elastic tongue includes a first end and a second end. The first end of the elastic tongue is fixedly attached to or integral with the handle body. The second end of the elastic tongue flexes towards a first extreme flexed position as the connector rotates towards the first extreme rotated position, and the second end of the elastic tongue flexes towards a second extreme flexed position as the connector rotates towards the second extreme rotated position, such that the flexed elastic tongue biases the connector towards the rest position. The connector includes a cartridge end and a tongue end opposite to the cartridge end, the cartridge end of the connector being adapted to engage with the cartridge. The elastic tongue has the form of an elastic sheet, the sheet extending in a plane perpendicular with the connector plane.

Being integral with the handle body (or fixedly attached thereto), the elastic tongue shows good stability and reliability during shaving. This configuration ensures that the second end of the elastic tongue (i.e. the portion which is being moved the most during flexing of the tongue) is not too far from the rotational axis. If the elastic tongue would be positioned on the connector part (similarly as in the above described background art) the tip of the tongue would be too far removed from the rotational axis, thereby rendering the whole system too sensitive to shaving motions. Too much sensitivity may lead to a situation, wherein minimal movements of the user are translated to shaving adjustments. The present configuration provides balanced parameters of the rotating parts, so that good precision is ensured without too much sensitivity to applied small forces.

The elastic tongue in the form of a sheet has been found to be the most optimal shape, since such an elastic tongue has several advantages. The elastic tongue in the form of a sheet is stable during elastic deformation, thereby keeping the movement of the connector sufficiently smooth when the connector is rotated. Further, such elastic tongue is in all its parts elastically homogeneous (unlike for example springs), which also contributes to more controllable, predicable and stable movement of the connector. Also, such an elastic sheet tongue does not distort in shape easily during use, thereby avoiding any mishaps.

Finally, when the connector is planar (i.e. extends in a connector plane), the elastic tongue also extends in the same connector plane, ensuring that the entire movement is kept in two-dimensions, thereby increasing its precision and reliability.

Embodiments may include one or more of the following additional features:

- the connector extends in a connector plane parallel with the longitudinal axis of the handle;
- the rotational axis is perpendicular to the connector plane; the connector rotates in the same plane in which it extends, which ensures that precise and reliable movement of the connector is achieved;
- the second end of the elastic tongue has an oval shape in the cross-section taken in a plane parallel with the connector plane, such that the second end of the elastic tongue is in the form of an oval portion, and the tongue end of the connector comprises a recess having a concave shape in a cross-section taken in a plane parallel with the connector plane;
- thickness of the elastic sheet decreases from the first end of the elastic tongue towards the second end of the elastic tongue;
- ratio between the thickness of the first end of the elastic tongue and the second end of the elastic tongue is anywhere between 1:1 and 2:1;

the second end of the elastic tongue has the form of an ellipse with a major axis extending along the longitudinal axis of the handle and the minor axis extending within a plane parallel with the connector plane;

ratio between thickness of the first end of the elastic tongue and thickness of the oval portion of the elastic tongue is anywhere between 0.6:1 and 0.9:1, and ratio between thickness of the portion of the elastic tongue neighbouring with the oval portion and thickness of the oval portion is anywhere between 0.4:1 and 0.6:1;

the recess of the tongue portion of the connector is in the form of a U-shape;

a pair of wings extends outwardly from each side of the recess and outwardly from each other, the pair of wings is symmetrical along the longitudinal axis of the handle, and each wing defines a plane, such that the respective planes of the pair of wings form a V-arrangement;

each plane of the pair of wings forms an angle between 30-60° with the longitudinal axis of the handle;

the handle body comprises a pair of stops, such that each stop is respectively adapted to prevent the elastic tongue to move beyond either the first extreme flexed position or the second extreme flexed position.

Further embodiments define a shaver comprising the handle as described above, wherein the shaver comprises a cartridge carrying at least one blade having a blade edge and extending along a blade edge axis.

The shaver may include one or more of the following additional features:

the rotational axis and pivot axis are perpendicular to each other;

the rotational axis and the pivot axis intersect each other;

the rotational axis intersects at least one cutting edge of the at least one blade;

the cartridge is pivotable about a pivot axis parallel to the blade edge axis.

DETAILED DESCRIPTION

The following description of the main embodiments of the present disclosure is made with reference to the accompanying drawings, where the same reference numbers denote identical or similar elements.

Figure 1:
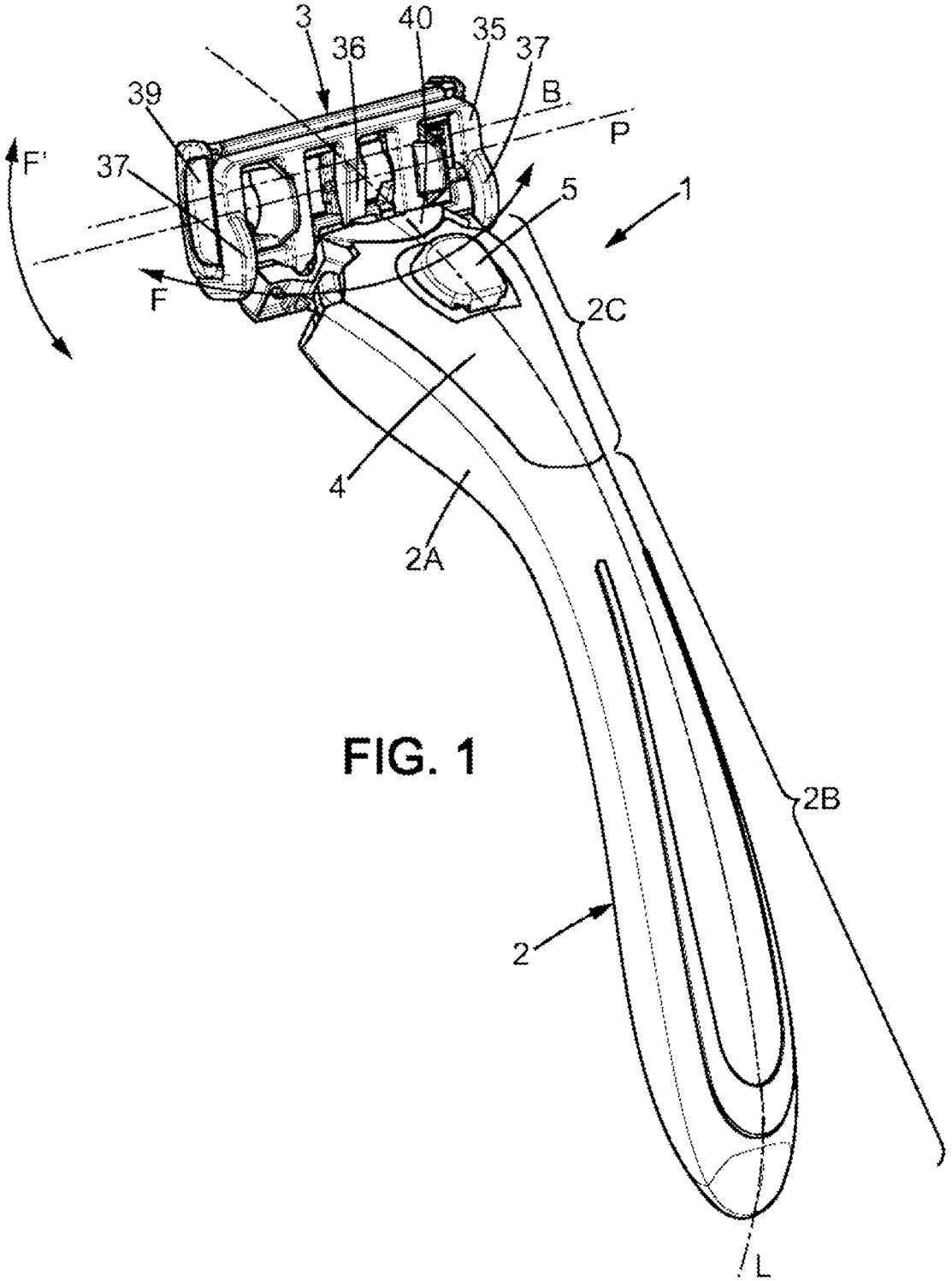
FIG. 1 is an overall perspective view of the shaver according to the present disclosure.

FIG. 1 shows an overview of an exemplary shaver 1 of the present disclosure. The shaver 1 comprises a handle 2, and a replaceable cartridge 3. The handle 2 comprises a hand gripping portion 2B and a connector portion 2C for connecting the handle 2 to the replaceable cartridge 3. The hand gripping portion could be elongated and may have any suitable shape, so that a user can hold the handle 2 in a hand. The handle 2 can be made of various materials, such as plastic or metal. The handle 2 may generally extend along a center line L. The handle 2 can have an arbitrary length.

The replaceable cartridge 3 of an exemplary embodiment has a generally elongated shape and extends substantially perpendicular to the longitudinal axis L of the handle 2. The replaceable cartridge 3 includes means for holding at least one blade 31, each such blade having a cutting edge 32. The cutting edge(s) 32 extend along a blade edge axis B, which is substantially parallel to a longitudinal axis of the replaceable cartridge 3, and substantially perpendicular to the longitudinal axis of the handle 2.

The cartridge 3 is adapted to pivot about a pivot axis P, which is substantially parallel with the blade edge axis B. In various embodiments, a pivot movement about the pivot axis P could be enabled in one or two directions. Generally, the pivoting about the pivot axis P is possible in the directions illustrated by arrow F' in FIG. 1. The cartridge 3 is further enabled to rotate about a rotational axis Z. The rotational axis Z could be perpendicular to the pivot axis P. The movement of the cartridge 3 about the rotational axis Z is possible in two directions as illustrated by the arrows F in FIG. 1.

Figure 9:
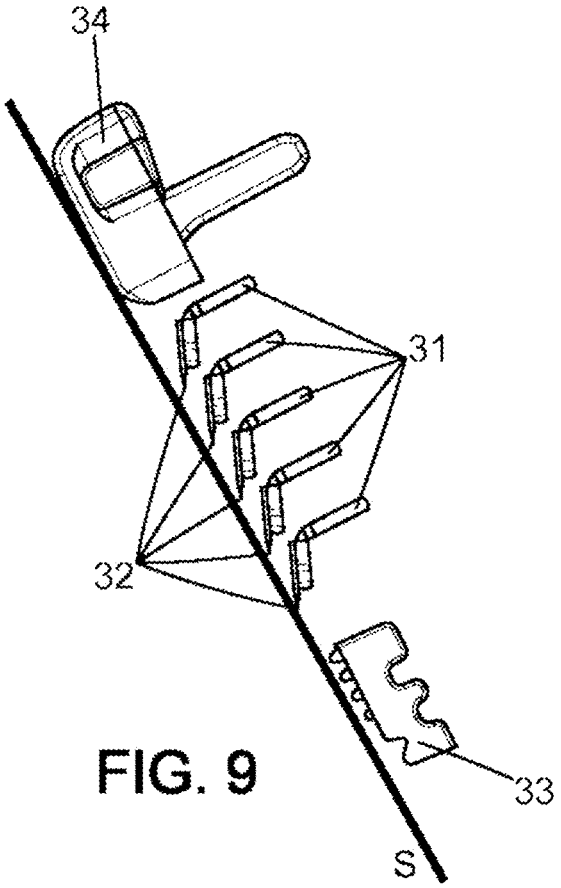
FIG. 9 is an illustration defining the term shaving plane S as used in the present disclosure.

The cartridge 3 may further comprise a guard 33 adapted to stretch the skin of a user before it reaches the cutting edge(s) 32, and/or a cap 34 adapted to treat the skin of the user after hairs are cut. The guard 33 and the cap 34 form skin engaging surfaces. The top surface of the guard 33 and the top surface of the cap 34 are used as general reference for defining a shaving plane S. The shaving plane S is defined entirely by the contours of the front side of the cartridge 3 where the cutting edges 32 are located. More explicitly, the shaving plane S could be defined as illustrated in FIG. 9, i.e. the shaving plane S is a plane tangent to the surface of the guard 33 and the surface of the cap 34. The shaving plane S does not intersect either the guard 33 or the cap 34 but touches both the guard 33 and the cap 34 at exactly one point of their surfaces. The at least one blade 31 may extend above, in, or below the shaving plane S, or may have any other suitable configuration, such as increasing or decreasing exposure. The exposure of the blade 31 is equal to the distance measured from the shaving plane S to the cutting edge 32 of the blade 31.

The cartridge 3 may comprise at least one cam surface 36, which could be abutted by a biasing means 650 adapted to return cartridge 3 to a neutral position, whenever the cartridge 3 is pivoted about the pivot axis P. Pivoting about the pivot axis X can be enabled by any suitable means. For example, a combination of shell bearings 38 in the form of rounded projections and corresponding rounded hooks 37 adapted to engage with the shell bearings 38. Alternative means, such as combination projecting pins and corresponding openings, are also possible.

Alternatively, the cartridge 3 may be formed by two separate parts, which are then attached to each other. Namely, the cartridge 3 may comprise a housing 39, and a back structure 35. Attachment between the housing 39 and the back structure 35 could be achieved by snap fitting, riveting, or similar means. The housing 39 may hold the at least one blade 31, and may include the guard 33 and/or the cap 34. The hooks 37, or any other suitable means for enabling pivotal movement, may be provided on the sides of the back structure 35. The at least one cam surface 36 may also be provided on the back structure 35. The back structure 35 is adapted to be engaged with the handle 2.

Figure 2:
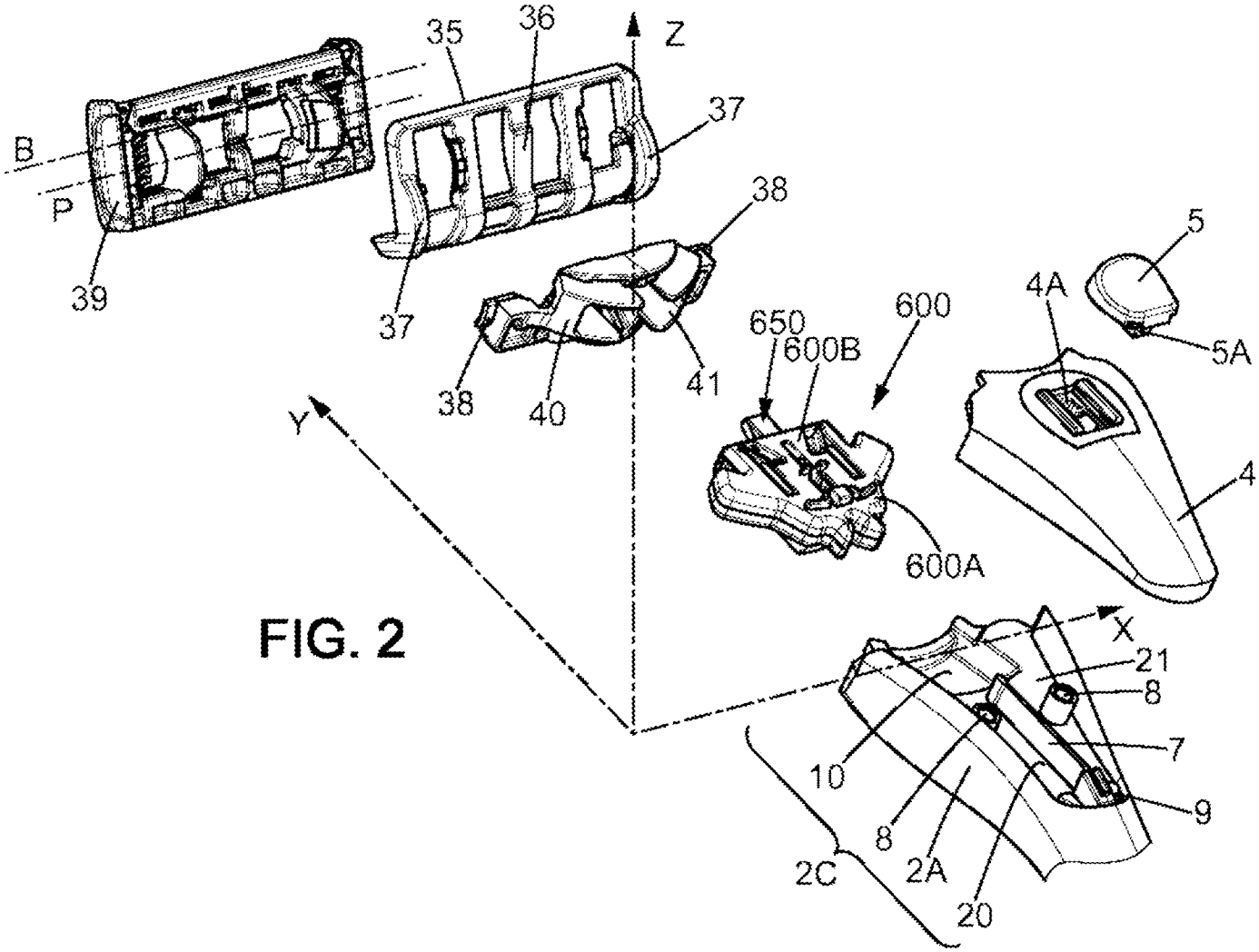
FIG. 2 is a partial exploded perspective view of the components of the shaver of FIG. 1.

Details of the engagement between the cartridge 3 and the handle 2 are visible in FIG. 2. Means for such engagement between the back structure 35 and the handle 2 are not particularly limited. In an embodiment as illustrated in FIG. 2, an intermediate component 40 is positioned between the handle 2 and the back structure 35. The intermediate component 40 comprises the shell bearings 38, which are engaged with the hooks 37 of the back structure 35, thus enabling the rotation about the pivot axis P. The position between the housing 39 and the back structure 35 of the cartridge 3 is fixed and does not change, while the relative position between the cartridge 3 and the intermediate component 40 changes. More precisely, the intermediate component 40 and the cartridge 3 pivot with respect to each other.

The intermediate component 40 may include a receiving aperture 41, into which a complementary part of the handle 2 can be inserted, in order to provide the engagement between the intermediate component 40 and the handle 2. Inside the receiving aperture 41, two holes (not shown in the drawings) can be provided, one on each side of the receiving aperture 41. Corresponding projections defined on the handle 2 are received by the holes inside the receiving aperture 41, such that the handle 2 and the intermediate component 40 are locked to each other, and the mutual movement of the handle 2 with respect to the intermediate component 40 is prevented. Further details of this connection will be apparent from FIG. 3 and the corresponding description below.

FIG. 2 shows the connection portion of the handle 2. The handle 2 includes a handle body 2A, a cover 4, a button 5 and a connector 600. The cover 4 is attached to the handle body 2A, for example, by snap fitting, or riveting, or any other suitable means. The cover 4 can be fixed to the handle body 2A permanently, or the cover 4 can be detachable from the handle body 2A. The cover 4 may include an opening 4A, in which the lower part of the button 5 is inserted. Specifically, the lower part of the button 5 comprises a projection 5A, which is received in the opening 4A, such that the projection 5A projects inside a hollow portion 20 of the handle body 2A.

The hollow portion 20 inside the handle body 2A is provided at the connection portion of the handle 2, i.e. adjacent to the cartridge 3. The bottom of the hollow portion 20 includes a substantially flat platform 21. The hollowed portion 20 includes an elastic tongue 7, which extends substantially along the longitudinal axis of the handle 2. The platform 21 can be divided into a far side, being the side the most distant from the cartridge 3, a close side, being the side closer to the cartridge 3, and a middle area lying between the far side and the close side. An attachment portion 9 projects from the far side of the platform 21. Two stops 8 are located in the middle area of the platform. On each side of the handle body 2A is located one stop 8. The stops 8 are located next to the elastic tongue 7. Each stop 8 is positioned on the opposite side of the handle body 2A with respect to the elastic tongue 7. At the close side of the platform 21 there is a depression 10. The depression 10 can have a shape of a circle sector, where this circle has the center on the rotational axis Z. Generally, the connector 600 is guided within the depression 10. As a result, there is rotational movement of the connector 600 with respect to the handle body 2A.

Figure 3A:
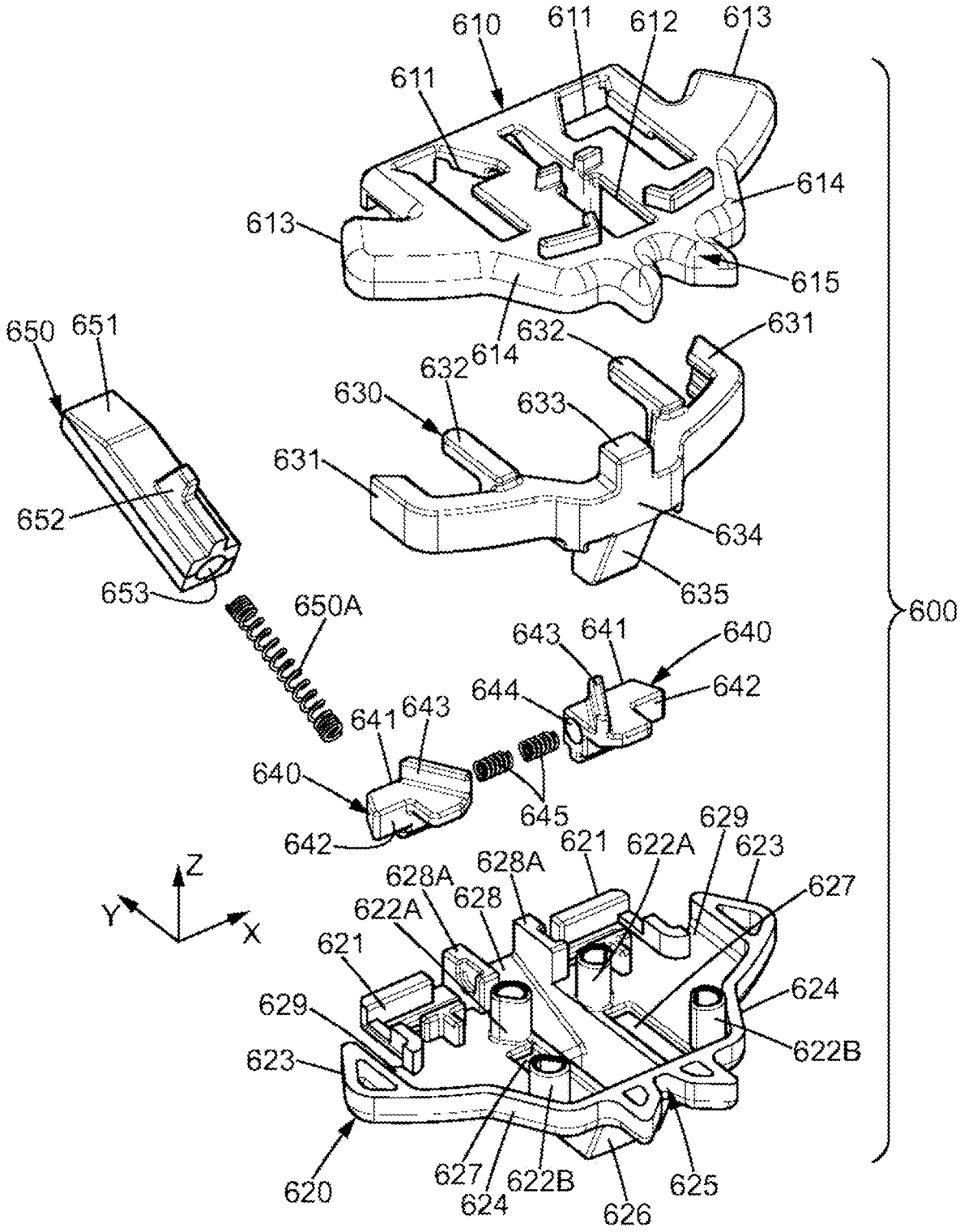
FIG. 3A shows a top exploded perspective view of the connector of FIG. 2.
Figure 3B:
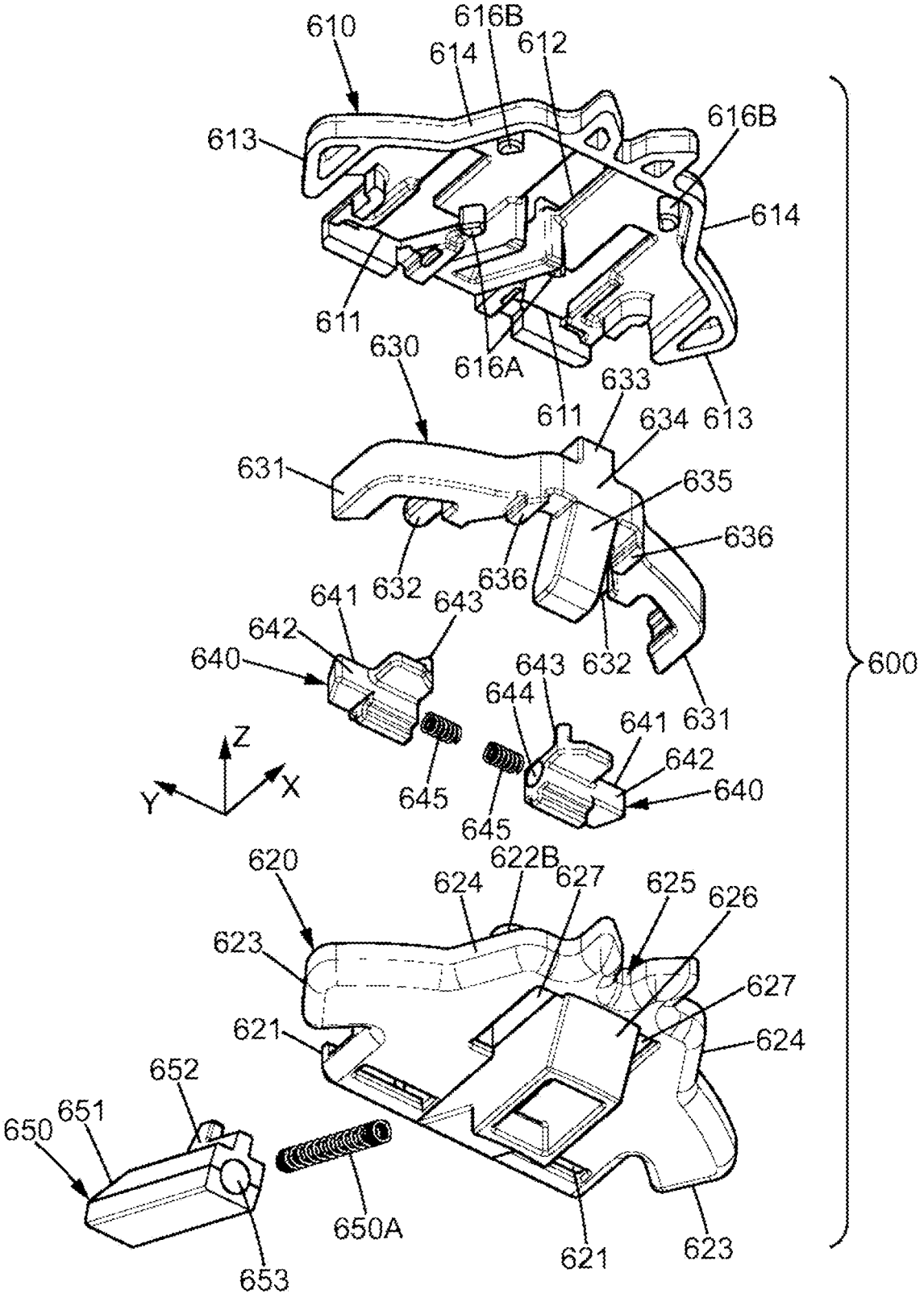
FIG. 3B shows a bottom exploded perspective view of the connector of FIG. 2.

FIG. 3 shows an exploded view of the connector 600. The connector 600 has a substantially flat shape and extends generally in a connector plane XY. The connector 600 is adapted to rotate within the connector plane XY around a rotational axis Z. The rotational axis Z is perpendicular to the connector plane XY. The longitudinal axis L of the handle 2 lies substantially within the connector plane XY. The rotational axis Z is also perpendicular to the longitudinal axis L of the handle 2. The connector plane XY is parallel with the plane, in which the flat platform 21 extends. The pivot axis P lies within the connector plane XY, or the pivot axis P is parallel with the connector plane XY. The connector 600 is symmetrical along the plane YZ defined by the connector plane XY and the rotational axis Z. The connector 600 is also symmetrical with respect to plane LZ defined by the longitudinal axis L and the rotational axis Z.

The connector 600 can be divided into a cartridge end 600B and a tongue end 600A, although both ends pertain to a single piece of material. The cartridge end 600B of the connector 600 has a shape complementary with the receiving aperture 41 of the intermediate component 40, such that the cartridge end 600B can be inserted into the receiving aperture 41. The connector 600 comprises a top part 610, a bottom part 620, a slider 630 sandwiched between the top part 610 and the bottom part 620, and a pair of lockers 640 also positioned between the top part 610 and the bottom part 620, where all of these parts are symmetrical with respect to plane YZ. The top part 610 comprises a pair of flank sections 613, and a pair of body sections 614. The body sections 614 form the center of the top part 610, and the flank sections 613 extend to the sides from each respective body section 614. The flank sections 613 also extend forwardly towards the cartridge 3. The shape of the flank section is rounded. When viewed from the top (as illustrated for example in FIGS. 6A and 6B), the side of the flank sections 613 facing the cartridge 3 has a shape of a part of a circle having the center on the rotational axis. The side of the flank sections 613 opposite the cartridge 3 also has a shape of a part of a circle having center on the rotational axis.

The top part 610 further comprises two side channels 611 and a central channel 612. The central channel 612 extends along the longitudinal axis L of the handle 2. The side channels 611 each include a passage, which extends in the same direction as the central channel 612, and a passage which extends perpendicularly and towards to the longitudinal axis L. The side channels 611 have generally the shape of letter P (or mirrored letter P). Each side channel 611 is located on opposite side of the top part 610 with respect to the central channel 612. The tongue end 600A of the connector 600 comprises a recess 615. On the bottom side of the top part 610, there are four protrusions 616A, 616B distributed along the bottom surface of the top part 610. There are four protrusions 616A, 616B shown in FIG. 3B. Two protrusions 616B are located at the tongue end 600A and two protrusions 616A are located at the cartridge end 600B, each pair positioned symmetrically with respect to the central channel 612. The protrusions 616A, 616B are received by complementary features provided on the bottom part 620, thus forming a connection between the top part 610 and the bottom part 620. As long as this function is fulfilled, the number of protrusions 616A, 616B may vary and they may be distributed relatively arbitrarily.

The bottom part 620, similarly to the top part 610, also comprises a pair of flank sections 623 and a pair of body sections 624. When the handle 2 is viewed from top (directions of the rotational axis Z) the flank sections 613 and the body sections 614 of the top part 610 overlap the flank sections 623 and the body sections 624 of the bottom part 620. Similarly to the top part 610, the bottom part 620 is also provided with a recess 625 at the tongue end 600A, the recess 625 of the bottom part 620 being overlapped by the recess 615 of the top part 610, when viewed from top (in the direction of the rotational axis Z). The bottom part 620 further comprises a set of tubes 622A and 622B for receiving the protrusions 616A, 616B provided at the bottom of the top portion 610. The tubes 622A, 622B and the protrusions 616A, 616B serve to attach the top part 610 to the bottom part 620. Nevertheless, alternative attaching means can be used as well, such as welding or gluing. In that case, neither the protrusions 616A, 616B, nor the tubes 622A, 622B would be present.

The bottom part 620 may further comprise a pair of front faces 621 at the very tip of the cartridge end 600B. The front faces 621 extend upwardly from the bottom part 620. Downwards from the bottom part 620 at the tongue end 600A, there extends a cavity 626. The cavity 626 forms a pocket. Although the cavity 626 is part of the connector 600, it is located generally below the connector plane XY. The cavity 626 has a shape complementary with the shape of the depression 10 in the handle body 2A. Sliding of the cavity 626 within the depression 10 results in the rotational movement of the connector 600 with respect to the handle body 2A. The bottom part 620 may also comprise a central groove 628, which extends from the base of the cavity 626 towards the cartridge end 600B. The central groove 628 is adapted to guide a pusher 650, which is part of the connector 600. Alongside the central groove 628 at the cartridge end 600B of the bottom part 620, there are positioned two walls 628A. There is one wall 628A on each side extending along the central groove 628. The walls 628B extend upwards from the bottom part 620. Further, there may be side grooves 629 located in the flank sections 623. The side grooves 629 may extend parallel with the longitudinal axis L, and they may be adapted to guide some portions of the slider 630, as further explained below.

The pusher 650 can comprise a cam following section 651, a rib 652 and an opening 653 for a spring 650A. The cam following section 651 cooperates with the at least one cam surface 36 of the cartridge 3. When the cartridge 3 is pivoted about the pivot axis P, the cam surface(s) 36 force the pusher 650 to slide within the central groove 628 towards the inside of the handle 2. As a result, the spring 650A is compressed, thus generating a return force biasing the pusher 650 back to its initial position, and thereby urging the cartridge 3 into the neutral position. The rib 652 of the pusher 650 is guided by the central channel 612 of the top part 610. Wobbling of the pusher 650 in the central groove is prevented. The rib 652 may not have the same height along its entire length. The rib 652 may be stepped, including one lower portion and one higher portion.

The slider 630 may be adapted to slide along the longitudinal axis L of the handle 2. The slider 630 is interposed between the top part 610 and the bottom part 620. The slider 630 may include a slider body 634, a pair of outer arms 631 and a pair of inner arms 632. The outer arms 631 are guided in the side grooves 629 of the bottom part. The shape of the outer arms 631 is such that the outer arms can be placed in the area created by the flank portions 613, 623 of the top 610 and bottom 620 parts of the connector 600. The outer arms 631 extend generally sideways from the slider body 634, and then (towards the ends of the outer arms 631) extend forwardly parallel with the longitudinal direction L of the handle towards the cartridge 3. The inner arms 632 project forwardly substantially from the middle of the outer arms 631 parallel with the longitudinal direction L and towards the cartridge 3. The ends of the outer arms 631, which are the parts most distant from the slider body 634, are parallel with the inner arms 632. The inner arms are guided within the side channels 611 of the top part 610, more particularly within the passage of the side channels 611, which extends parallel with the longitudinal axis L. The slider 630 may also include a pair of guides 636, which extend downwardly from the outer arms 631. The guides 636 can be in the form of elongated ribs extending along the longitudinal axis L of the handle 2. The guides 636 are adapted to be received in the bottom channels 627 of the bottom part 620, so that the slider is conveniently retained in its desired position. Specifically, the slider 630 is prevented from side-to-side movement.

Figure 5:
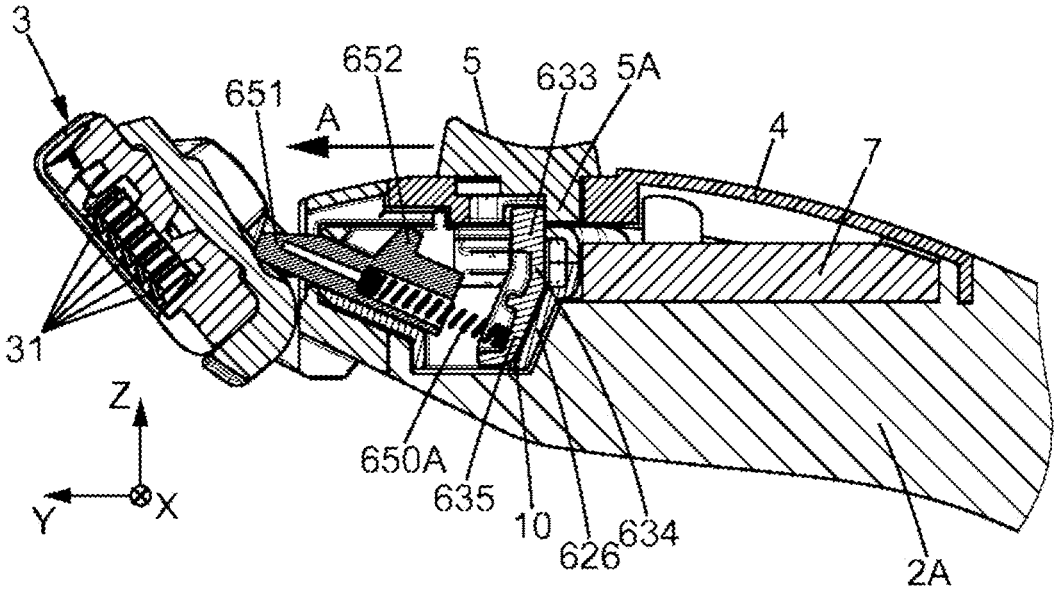
FIG. 5 shows a side cross-section of the portion of the handle body adjacent to a cartridge connected to the cartridge.

The slider 630 may further include an upper extension 633 projecting upwards from the slider body 634. The upper extension 633 is shaped to be received in the central channel 612 of the top part 610. The slider 630 is supported by the top part 610 and is prevented from moving sideways. The slider may further include a lower extension 635 projecting downwards from the slider body 634. The lower extension 635 is received in and guided by the cavity 626 of the bottom part 620. The lower extension 635 abuts with and functionally cooperates with the spring 650A. The spring 650A is generally positioned between the interior face of the opening 653 and the lower extension 635, as illustrated in FIG. 5. When the slider 630 is moved forward towards the cartridge 3, the spring 650A is contracted and urges the pusher 650 to exert pushing force on the cam surface(s) 36 of the cartridge 3.

Figure 4:
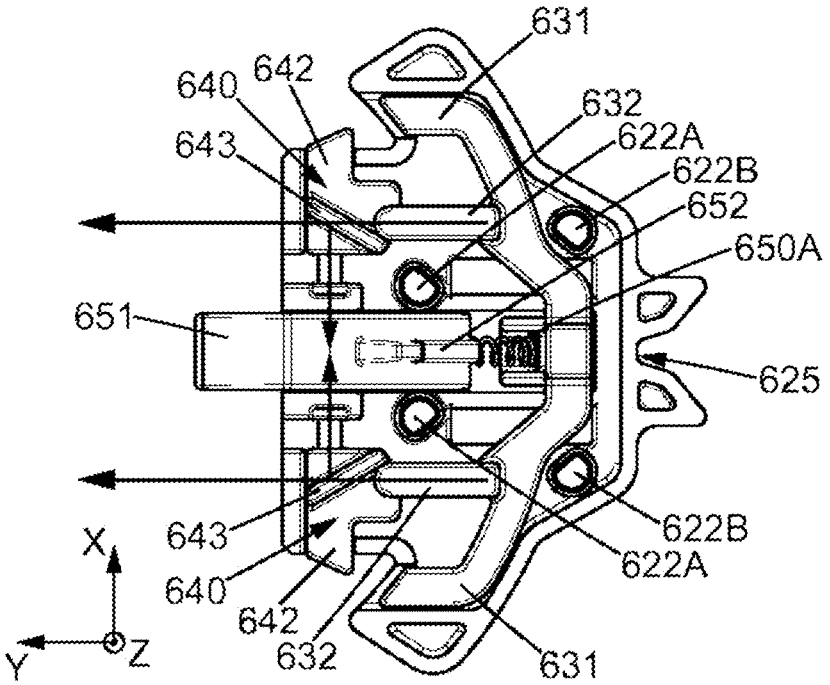
FIG. 4 shows a top view of the connector without the upper housing.

FIG. 4 shows that the lockers 640 are located at the cartridge end 600B of the connector 600. The lockers 640 may be aligned with the front faces 621 of the bottom part 620. The lockers 640 are adapted to slide perpendicular to the longitudinal axis L. The bottom side of the lockers 640 may be provided with projections, which may be adapted to fit in a complementary features in the bottom part 620, such as suitable pair of grooves. The lockers 640 are generally restricted from movement along the longitudinal axis L. The lockers 640 are movable in a direction towards and away from each other (direction of axis X). The lockers 640 may further be guided in the side channels 611 of the top part 610, more particularly, the lockers 640 are guided in those passages of the side channels 611, which extend perpendicularly to the longitudinal axis L. Each locker 640 comprises a pin 642 extending outwardly along the axis X. The pins 642 are adapted to be received in the respective hole (not shown on the drawings) of the intermediate component 40 located inside the receiving aperture. When the pins 642 of the lockers 640 are engaged in the hole of the receiving aperture 41, the intermediate component 40 (and therefore also the cartridge 3) is engaged with the handle 2. The pins 642 are aligned with the front faces 621 of the bottom part 620, more particularly, the pins 642 slide along the front faces 621.

The lockers 640 further include a ridge 643. Initially, one end of the ridge 643 is in contact with a corresponding end of the corresponding inner arm 632. From the point of contact with the inner arm 632, the ridge 643 extends forwardly and sideways, such that it forms an angle with the longitudinal axis L of the handle 2. The angle between the ridge 643 and the longitudinal axis L may be 15-45°, and in some instances, 35° or 40°. When the slider 630 slides forwardly towards the cartridge 3, the ends of the inner arms 631 move along the ridges 643, thereby forcing the lockers 640 to slide towards each other (i.e. in the direction towards the pusher 650). Once the lockers 640 are forced to slide towards each other, the pins 642 are disengaged from the holes (not shown on the drawings) of the receiving aperture 41, and the handle 2 is disengaged from the intermediated component 40 (and therefore also from the cartridge 3).

The lockers 640 may further include an opening 644 for a locker spring 645. Each locker spring 645 may extend between the interior face of the opening 644 and the respective wall 628A, which extends alongside the central groove 628. When the lockers 640 are pushed towards each other by the inner arms 632, the locker springs 645 get compressed, thereby generating a return force, urging the lockers 640 back into their initial position. The biasing force of the locker spring 645 is also applied through the lockers 640 onto the slider 630. The slider 630 is also partially urged into its initial position by the locker springs 645. When the slider 630 is moved forwards, the spring 650A gets also contracted, forcing the slider 630 back into its initial position. Thus, the spring 650 A has two functions. On one hand, it generates biasing force returning pivoted cartridge 3 into the neutral position, and on the other hand, it also generates biasing force returning the slider 630 into its initial position, after the slider 630 is slid forwards.

FIG. 5 illustrates that the handle is provided with a button 5, which is slidable along the longitudinal axis L of the handle 2. The button 5 is positioned on the cover 4. The button 5 comprises a projection 5A projecting through the opening 4A in the cover inside the handle body 2A. The projection 5A abuts with the upper extension 633 of the slider 630. When the user decides to replace shaving cartridge 3, he/she may slide the button 5 forward with his/her finger in the direction of the arrow A. As the button 5 is slid forward, the slider 630 is also slid forward. The lockers 640 are moved towards each other, thereby disengaging the pins 642 from the holes of the receiving aperture 41. The connector 600 is disconnected from the intermediated component 40. As a result, the cartridge 3 is disconnected from the handle 2.

The intermediate component 40 and the connector 600 can alternatively be provided in a single piece. In this embodiment, the cartridge 3 is not replaceable and the features related to unlocking the connection between the handle 2 and the cartridge 3 (or more particularly between the intermediated component 40 and the connector 600) are omitted. Therefore, the button 5, the opening 4A, the slider 630, and the lockers 640 are omitted.

The connector 600, the intermediated component 40 and the cartridge 3 are adapted to rotate about the rotational axis Z. The rotation of the connector 600 about the rotational axis Z is enabled by the cavity 626 being positioned in the depression 10, such that the cavity 626 can slide along the rounded walls of the depression 10. The intermediate component 40 is engaged with the connector 600 by means of the lockers 640 and the holes located inside the receiving aperture 41, thus the rotation of the connector 600 causes simultaneous rotation of the intermediate component 40. The intermediate component 40 is attached to the cartridge 3 (either directly to the housing 39, or to the back structure 35 if present). Therefore, when the intermediate component 40 rotates about the rotational axis Z, the cartridge 3 rotates as well. The connection between the intermediate component 40 and the cartridge 3 further enables pivoting movement about another axis, the pivot axis P.

The rotational axis Z is located such that it intersects the cartridge 3. In some examples, the rotational axis Z can intersect the cutting plane defined by the cutting edges 32 of the blades 31. The cutting plane is the plane, which is tangent to the plurality of cutting edges 32, i.e. the cutting plane has one point of contact with each of the cutting edges 32 present in the cartridge 3. The rotational axis Z may also directly intersect with one of the cutting edges 32. The distance between the rotational axis Z and the closest cutting edge 32 is not more than 1 mm, and in some examples not more than 0.5 mm. The rotational axis Z is perpendicular to the longitudinal axis L of the handle 2. The rotational axis Z is perpendicular to the connector plane XY. The rotational axis Z and the pivot axis P intersect each other, such that they both lie in a common plane ZP. The rotational axis Z and the pivot axis P may intersect directly in the shaving plane S. Nevertheless, other configurations are possible as well, namely configuration where the intersection of the rotational axis Z and the pivot axis P is located above or below the shaving plane S.

The pivot axis P is parallel with the connector plane XY, for example, the pivot axis may lie in the connector plane XY. The pivot axis P intersects the cartridge 3. The pivot axis P can be parallel with the blade edge axis B of the cutting edge 32 of the at least one blade 31. The pivot axis P may lie in the cutting plane, or in some embodiments the pivot axis P can be identical with a blade edge axis B (when the shaver 1 is assembled and the cartridge 3 is in neutral position).

Figure 6A:
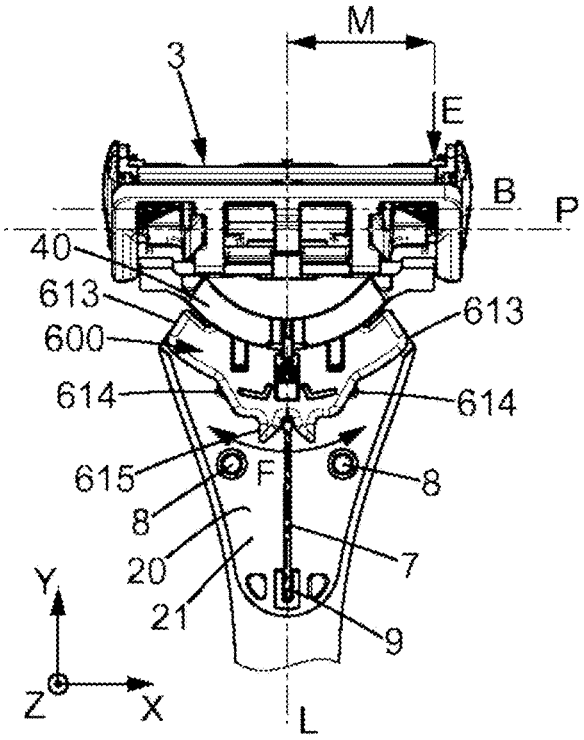
FIG. 6A shows the connector and the cartridge in the non-rotated position.

FIG. 6A shows the connector 600 in the rest position. The connector 600 is rotatable in both directions indicated by the arrow F. In the rest position, the flank sections 613, 623 may be substantially included in the hollow portion 20, i.e. covered from below by the handle body 2A, and covered from above by the cover 4. When the connector 600 is rotated about the rotational axis Z, the corresponding flank sections 613, 623 protrude partially outside the hollow portion 20. During rotation of the connector 600, the flank sections 613, 623 slide along the edges of the handle body 2A located at the end of the connector portion of the handle 2 (as is apparent from FIG. 6B).

Figure 6B:
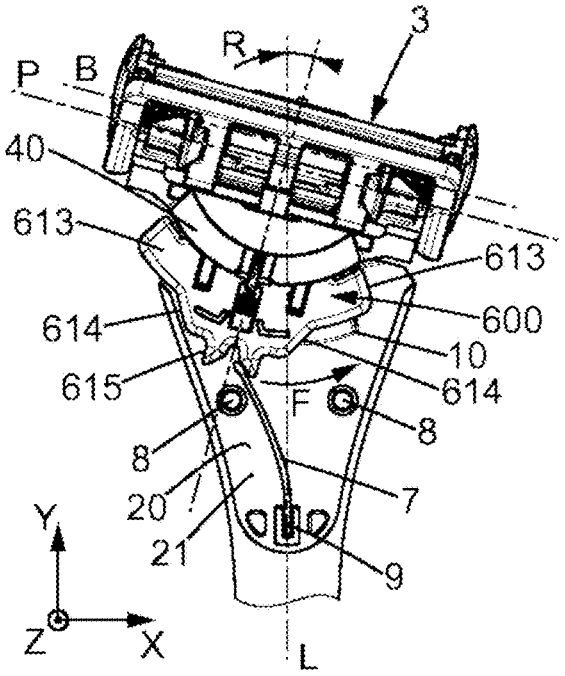
FIG. 6B shows the connector and the cartridge in a rotated position.

FIG. 6B shows the connector 600 in a rotated position. The connector 600 is rotated about an angle of rotation R, with respect to the longitudinal axis L. The connector 600 generally rotates between a first extreme rotated position and a second extreme rotated position. In each of the first and second extreme positions, the corresponding body sections 614, 624 abut with one of the side walls of the handle body, thus stopping the motion of the connector 600. As the connector 600 is rotated towards one of the first or second extreme rotated positions, the elastic tongue 7 is flexed. The flexion of the elastic tongue 7 generates a return torque force urging the connector 600 back into its rest position. When the connector 600 is rotated to the left, the elastic tongue 7 is flexed also to the left. When the connector 600 is rotated to the right, the elastic tongue 7 is flexed also to the right. Flexing of the elastic tongue 7 is only allowed within the area defined by the two stops 8, which prevent the elastic tongue from flexing too much.

The return torque generated by the elastic tongue 7 lies between 0 N.mm and 30 N.mm, in some examples between 10 and 30 N.mm, and in other examples between 15 N.mm and 25 N.mm. The return toque exerted by the elastic tongue 7 increases, as the connector 600 is rotated to either side. The increase of the return toque may depend on the angle of rotation R of the connector 600 either linearly or non-linearly. The increase of the return toque per degree may lie between 0.5 N.mm and 2 N.mm, in some examples between 0.67 N.mm and 2 N.mm, and in other examples between 1 N.mm and 1.67 N.mm.

The values of the return toque defined in the preceding paragraph are measured in the following manner. The cartridge 3 is pivoted about the pivot axis X into the fully pivoted position, where it is kept during the entire time of measuring. A testing force E is applied on a point of the front surface of the cartridge 3, where the cutting edges 32 are located. The point on which the force E is applied lies substantially in the shaving plane S. As illustrated in FIG. 6A, the testing force E is applied perpendicular to the shaving plane S. The testing force E is applied at a selected distance M with respect to the plane of symmetry of the cartridge 3, this plane of symmetry being identical with plane LZ in FIG. 6A. Because of the testing force E, the connector (600) is rotated about a concrete angle of rotation R.

The distance M between the plane LZ and the point of application of the testing force E corresponds to a moment arm. By multiplying the value of the moment arm M with the value of the testing force E one obtains the value of the return torque exerted by the elastic tongue (7) for the particular situation, where the connector (600) is rotated about the concrete angle of rotation R. In this way, the values of return toque can be measured for an arbitrary angle of rotation R.

Figure 7:
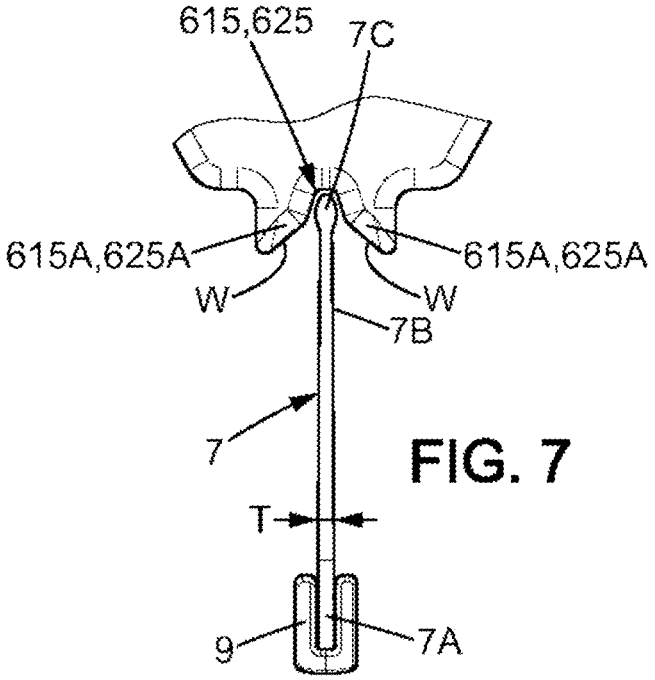
FIG. 7 is a detail of the elastic tongue and the recess on the tongue end of the connector.
Figure 8:
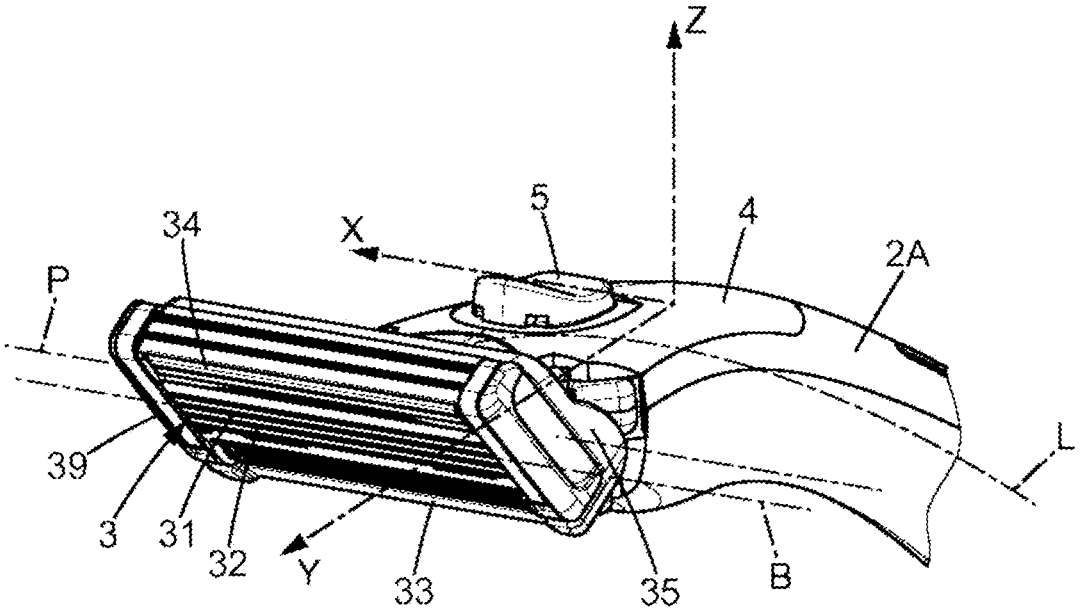
FIG. 8 is a front perspective view of the handle body of FIG. 5.

FIG. 7 shows that the elastic tongue comprises a first end 7A and a second end 7B. The elastic tongue 7 may be made of plastic or metal, or other suitable flexible material. The attachment portion 9 fixes the first end 7A of the elastic tongue 7 to the handle body 2A. In alternative embodiments, the elastic tongue 7 may be integral part of the handle body 2A. The second end 7B of the elastic tongue 7 is freely movable within the borders defined by the stops 8. More particularly, the second end 7B of the elastic tongue 7 flexes towards a first extreme flexed position as the connector 600 rotates towards the first extreme rotated position, and the second end 7B of the elastic tongue 7 flexes towards a second extreme flexed position as the connector 600 rotates towards the second extreme rotated position, such that the flexed elastic tongue 7 biases the connector 600 towards the rest position. The second end 7B is inserted into the recess 615, 625.

When not flexed, the elastic tongue 7 is substantially linear and extends along the longitudinal axis L of the handle 2. The elastic tongue 7 may have any suitable shape. For example, the elastic tongue may be in the form of spring (such as helical spring, or torsion spring). The elastic tongue 7 may have a form of an elastic sheet as is visible in FIG. 5 showing the elastic tongue from a side. The elastic sheet may extend in the plane ZY. The elastic sheet can have any shape that may be for example, a substantially rectangular shape, the longer side of the rectangle (extending along the Y-axis) being parallel with the longitudinal axis L, and the shorter side (extending along the Z-axis) of the rectangle being perpendicular to the longitudinal axis L. The dimension of the elastic tongue 7 along the Z-axis may be between 2.5 and 3.5 mm, for example 3 mm. The dimension of the elastic tongue 7 along the Y-axis may be between 18 mm and 25 mm, for example 19 mm, 21 mm or 23 mm. The elastic tongue in the form of an elastic sheet may have a thickness T corresponding to the dimension taken along the X-axis. The average thickness of the elastic tongue 7 could be between 0.6 mm and 0.8 mm, for example 0.7 mm.

The second end 7B of the elastic tongue may comprise any shape, for example, an oval portion 7C. The oval portion 7C having an oval shape in the cross-section taken in a plane parallel with the connector plane XY. The oval portion 7C may be in the form of an ellipse with a major axis extending along the longitudinal axis L of the handle 2 and the minor axis extending within a plane parallel with the connector plane XY.

The thickness T of the elastic tongue 7 at the first end 7B may be greater than the thickness T of the elastic tongue 7 at the second end 7B. The thickness T may continuously decrease from the first end 7A towards the second end 7B (this being true with the exception of the oval portion 7C, which forms a special part of the elastic tongue). Ratio between the thickness T of the first end 7A of the elastic tongue 7 and the second end 7B of the elastic tongue 7 can be anywhere between 1:1 and 2:1, for example 1.5:1. Ratio between thickness of the first end of the elastic tongue 7 without the considering the oval portion 7C and the maximum thickness T of the oval portion of the elastic tongue 7 may be between 0.6:1 and 0.9:1, for example 0.75:1. Ratio between thickness T of the portion of the second end 7B of the elastic tongue 7 neighbouring with the oval portion 7C and the maximum thickness of the oval portion may be between 0.4:1 and 0.6:1, for example 0.5:1.

The recess 615, 625 has such a shape that is allows some clearance between the second end 7B of the elastic tongue 7 and the inner surface of the recess 615, 625. The second end 7B is not fixedly fitted in the recess 615, 625. The recess 615, 625, more particularly, the inner surfaces of the recess may have a concave shape in a cross-section taken in a plane parallel with the connector plane XY. The recess 615, 625 can be in the form of a U-shape. A pair of wings 615A, 625A may extend outwardly from each side of the recess 615, 625 and outwardly from each other. The pair of wings 615A, 625A is symmetrical along the longitudinal axis L of the handle 2, and each wing defines a planar surface W, such that the respective planar surfaces W of the pair of wings 615A, 625A form a symmetrical V-arrangement with respect to the longitudinal axis L of the handle 2. Each planar surface W of the pair of wings 615A, 625A forms an angle between 30-60° with the longitudinal axis L of the handle 2, for example this angle can be 40° or 50°.

The invention claimed is:

1. A handle for a shaver comprising:

a handle body;

a connector; and an elastic tongue;

the handle body including a hand gripping portion, the handle body extending along a center line of the handle;

the connector having a cartridge end for attaching a cartridge to the handle body, and a tongue end opposite the cartridge end for engaging with the elastic tongue;

the connector extending between the cartridge end and the tongue end to define a connector plane;

the connector being rotatable with respect to the handle body about a rotational axis, the rotational axis being substantially perpendicular to a portion of the center line of the handle that extends along the connector, wherein the connector is rotatable from a rest position and between a first extreme rotated position and a second extreme rotated position;

the elastic tongue being an elastic sheet having a first end and a second end, the elastic tongue extending substantially parallel with a portion of the center line of the handle that extends along the elastic tongue and extending in a plane perpendicular with the connector plane, when in a neutral position;

the first end of the elastic tongue being fixedly attached to the handle body; and the second end of the elastic tongue being capable of flexing towards a first extreme flexed position as the connector rotates towards the first extreme rotated position, and the second end of the elastic tongue being capable of flexing towards a second extreme flexed position as the connector rotates towards the second extreme rotated position, such that the elastic tongue biases the connector towards the rest position, wherein the handle body includes a pair of stops, each stop is respectively adapted to prevent the elastic tongue from moving beyond either the first extreme flexed position or the second extreme flexed position, wherein the tongue end of the connector includes a recess that receives the second end of the elastic tongue and has a shape having clearance between the second end of the elastic tongue and an inner surface of the recess, and wherein the tongue is a flexible tail and has a tip at the second end in the recess, and wherein the tip moves in the recess so that the tip only contacts one side of the recess when the connector moves from the rest position to the first extreme flexed position.

2. The handle according to claim 1, wherein the connector plane is parallel with the center line of the handle.

3. The handle according to claim 1, wherein the rotational axis is perpendicular to the connector plane.

4. The handle according to claim 1, wherein the elastic tongue has a thickness that decreases from the first end of the elastic tongue towards the second end of the elastic tongue.

5. The handle according to claim 1, wherein the elastic tongue, when flexed, generates a return torque of between 0 N.mm and 30 N.mm.

6. The handle according to claim 1, wherein the elastic tongue generates an increasing return torque upon an increase in an angle of rotation of the connector, and wherein the increase of the return torque per degree of rotation lies between 0.5 N.mm and 2 N.mm.

7. The handle according to claim 1, wherein the tongue end of the connector includes the recess having the shape that is a rounded shape in cross-section taken in a plane parallel with the connector plane.

8. The handle according to claim 7, further including a pair of wings extending outwardly from each side of the recess in a direction away from each other, the pair of wings being symmetrical along the center line of the handle, each wing defining a planar surface, wherein the planar surfaces of the pair of wings forms a symmetrical V-arrangement with respect to the center line of the handle.

9. The handle according to claim 8, wherein each planar surface of the pair of wings forms an angle of between 30° and 60° with respect to the center line of the handle.

10. A shaver including the handle according to claim 1, the shaver having the cartridge carrying at least one blade having a blade edge and extending along a blade edge axis.

11. The shaver according to claim 10, wherein the rotational axis intersects the blade edge axis of the at least one blade.

12. The shaver according to any one of claim 10, wherein the cartridge is pivotable about a pivot axis parallel to the blade edge axis.

13. The shaver according to claims 12, wherein the rotational axis and a pivot axis intersect each other.

14. The shaver according to claim 12, wherein the rotational axis and a pivot axis are perpendicular to each other.

* * * * *